US006938571B1

(12) United States Patent
Pollack

(10) Patent No.: US 6,938,571 B1
(45) Date of Patent: Sep. 6, 2005

(54) FLOATING STRUCTURE HAVING ANCHOR LINES COMPRISING DAMPING MEANS

(75) Inventor: Jack Pollack, Monaco (MC)

(73) Assignee: Single Buoy Moorings Inc., Marly (CH)

( * ) Notice: Subject to any disclaimer, the term of this patent is extended or adjusted under 35 U.S.C. 154(b) by 0 days.

(21) Appl. No.: 09/959,281

(22) PCT Filed: Apr. 20, 1999

(86) PCT No.: PCT/EP99/02836

§ 371 (c)(1),
(2), (4) Date: Jan. 7, 2003

(87) PCT Pub. No.: WO00/63067

PCT Pub. Date: Oct. 26, 2000

(51) Int. Cl.[7] ..... B63B 35/44
(52) U.S. Cl. ..... 114/264; 405/219; 405/224
(58) Field of Search ..... 405/224, 203, 405/219, 223.1; 114/264, 265, 266

(56) References Cited

U.S. PATENT DOCUMENTS

| | | | | |
|---|---|---|---|---|
| 1,341,677 A | | 6/1920 | Roberts | |
| 3,327,780 A | * | 6/1967 | Knapp et al. | 166/352 |
| 3,986,471 A | | 10/1976 | Haselton | |
| 4,065,822 A | | 1/1978 | Wilbourn | |
| 4,470,724 A | * | 9/1984 | Pollack | 405/211 |

FOREIGN PATENT DOCUMENTS

| | | |
|---|---|---|
| GB | 2 066 291 | 7/1981 |

OTHER PUBLICATIONS

McKenna, H. "Synthetic Fibers can Aid Deepwater Mooring," vol. 47, No. 11, pp. 35-36, XP002072531, Petroleum Publishing Co., Tulsa, OK, USA.
Irish, James et al. "Elastic Tether Technology for Shallow Water Moorings in Harsh Environments: Results from Georges Bank," Proc. of the Ocean Engineering in the Environment Conference, Oceans, IEEE, 1996, pp. 635-639, XP000725509, New York, NY, US.
Abstract of Japanese Patent 56-116588, Sep. 1981.

* cited by examiner

*Primary Examiner*—Michael Safavi
(74) *Attorney, Agent, or Firm*—Young & Thompson

(57) ABSTRACT

A floating structure (1), such as a mooring buoy, moored to the seabed (2) via anchor lines (3,4) that comprise an anchor line section (9,10) which is stretchable in its length direction, such as a polyester line. A water-resistant element (7,8) is connected at or near the upper end of at least one of the stretchable anchor line sections (9,10) for resisting displacement in the length direction of the anchor lines (3,4). Preferably the water-resistance element (7,8) is connected to the floating structure (1) via a substantially non-stretchable anchor line section (5,6), such as chain section. The floating structure (1) can be moored in deep water, and reduces fatigue weakening of the floating structure (1) and of the anchor lines (3,4).

5 Claims, 1 Drawing Sheet

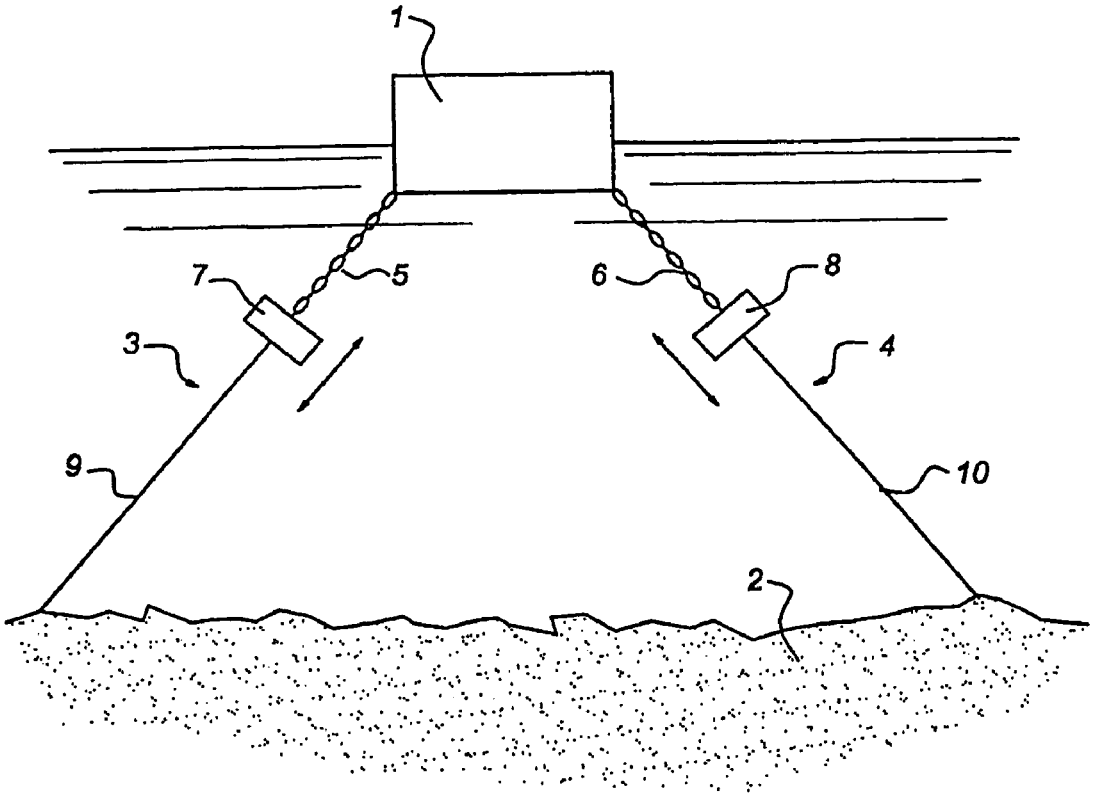
1
7
5
6
8
3
4
9
10
2

FLOATING STRUCTURE HAVING ANCHOR LINES COMPRISING DAMPING MEANS

Floating structure having anchor lines comprising damping means.

BACKGROUND OF THE INVENTION

The invention relates to a floating structure that can be moored to the seabed via anchor lines, at least one of the anchor lines comprising damping means for damping movements of the floating structure.

From U.S. Pat. No. 5,222,453 a marine structure is known, such as a semi-submersible drilling and production platform, which comprises anchor lines provided with clump weights or water-resistance elements to increase the dynamic mass of the anchor lines and to reduce the movements of the floating structure. Under varying loads on the anchor lines, the water resistance elements are displaced transversely to the length direction of the anchor lines. The water-resistance elements may comprise hollow spheres attached to the anchor lines, a plurality of radial fins or a radial slab. The water resistance elements damp movements of the anchor lines perpendicular to their length direction.

For anchoring floating structures in deep water, the anchor lines have considerable lengths, such as 1000 m or more. The anchor lines can in that case no longer be comprised of catenary chains, as the weight of such chains would become too large, and could, especially when the floating structure is a relatively small sized mooring buoy, submerge the floating structure. Catenary chains, used in shallow waters, have a damping effect on the movements of the floating structure. When anchor lines other than catenary chains are used, additional damping means must be provided in order to obtain a stable dynamic behaviour of the anchored structure. Radial fins or slabs such as known from the above prior art reference are not suitable for providing such a damping force when used in deep water.

SUMMARY OF THE INVENTION

It is therefore an object of the present invention to provide a floating structure that can be anchored in deep water, which comprises anchor lines and effective damping means and which has a stable moored position. It is another object of the present invention to provide a floating structure that can be moored in deep water in a stable manner and that can be of a relatively small size.

Thereto the floating structure according to the present invention is characterised in that at least one of the anchor lines comprises an anchor line section which is stretchable in its length direction, the damping means comprising a water resistance element connected at or near the upper end of at least one of the anchor lines, the water-resistance element having a projection which lies in a plane defined by two mutual perpendicular directions, the two directions being perpendicular to the length direction of the anchor lines, for resisting displacement in the length direction of the anchor lines.

By the water resistance element according to the present invention, which is located relatively close to the floating structure, the movements of the floating structure in the length direction of the anchor lines can be effectively damped, resulting in a reduction of fatigue weakening of the anchor lines and of the floating structure. This allows for the use of lightweight anchor lines, such as polyester lines, which tend to be relatively stretchable in their length direction, for anchoring in deep water.

In one embodiment according to the present invention, the at least one anchor line comprises a substantially non-stretchable section connected between the floating structure and the stretchable section, the damping means being attached to the substantially non-stretchable anchor line section. The non-stretchable section may be a chain part, connected to a polyester anchor line section extending to the seabed. The damping means may comprise a disc of a diameter between 1 and 10 m, attached to the end of the chain part, which may have a length of between 10 and 200 m. The total length of the anchor lines may be between 500 and 5000 m.

The floating structure may comprise a relatively small, round mooring buoy, with a height of for instance 7 m and a diameter of 14 m. With the anchoring construction of the present invention, favourable angular dynamics may be obtained for such a mooring buoy in deep water.

BRIEF DESCRIPTION OF THE DRAWINGS

The invention will be explained in detail with reference to the sole FIGURE of the accompanying drawing.

DESCRIPTION OF THE PREFERRED EMBODIMENTS

The figure shows a mooring buoy 1, which is anchored to the seabed 2 via taut anchor lines 3,4. The anchor lines 3,4 comprise a chain part 5,6 of a length of for instance 50 meter. At the end of the chain parts 5,6 a water resistance element 7,8 is connected, which may be of generally disc-shaped construction. The water-resistance elements 7,8 extend in a plane that is located perpendicular to the plane of the drawing. Even though the water resistance element 7,8 is shown to be of a generally two-dimensional construction, the thickness of the element in the length direction of the anchor lines may be increased for increased strength.

The anchor lines 3,4 comprise polyester line parts 9,10, which are taut between the seabed 2 and the chain parts 5,6. The polyester line parts 9,10 are relatively stretchable. The term "relatively stretchable" is intended to mean anchor lines, which are subject to at least 2% elongation in their length direction upon applying a tensile load. The length of the anchor line sections 9,10 may for instance be 1000 meters or more.

Upon heave motions of the mooring buoy 1, the water resistance elements 7,8 will exert a drag force on the chain sections 5,6 and the polyester lines 9,10 in the direction of the arrows, such that the displacement amplitude of the mooring buoy 1 is reduced, and fatigue weakening of the buoy 1 and the polyester line sections 9 and 10 is limited.

It will be clear to the skilled person that many variations in the number, type and shape of water resistance elements 7,8 may be used. Instead of a single damping member with a large surface area, it is also possible to attach multiple smaller surface area damping members, located at spaced apart positions along the anchor line. Furthermore, the chain sections can be replaced by steel cables or cables of synthetic fibres which are substantially non-stretchable, or combinations thereof.

What is claimed is:

1. A floating structure, comprising:

a floating part; and anchor lines for mooring said floating part to a seabed, at least one of said anchor lines comprising a substantially non-stretchable chain having an upper end fixedly connected to said floating part, a taut synthetic fiber line whose lower end is connected to the seabed and that is stretchable at least 2% in a length direction under a tensile load, and at least one water-resistance element connected between a lower end of said chain and an upper end of said synthetic fiber line, said at least one water-resistance element comprising a projection that is transverse to a length direction of said at least one anchor line for resisting displacement in the length direction of said at least one anchor line upon stretching of said synthetic fiber line.

2. The floating structure of claim 1, wherein said projection comprises a disc with a diameter of 1 to 10 meters.

3. The floating structure of claim 1, wherein said chain has a length of 10 to 200 meters.

4. The floating structure of claim 3, wherein said at least one anchor line has a length of 500 to 5000 meters.

5. The floating structure of claim 1, wherein said projection extends is a plane perpendicular to the length direction of said at least one anchor line.

* * * * *